US010271598B2

(12) United States Patent
Ferlic et al.

(10) Patent No.: US 10,271,598 B2
(45) Date of Patent: Apr. 30, 2019

(54) FABRIC REALIGNMENT USING THE Z-PLASTY TECHNIQUE

(71) Applicants: Randolph James Ferlic, Granger, IN (US); Kimberly Kate Ferlic, Granger, IN (US); Richard Anthony de los Santos, Goshen, IN (US); Krissie Marie Littman, Goshen, IN (US)

(72) Inventors: Randolph James Ferlic, Granger, IN (US); Kimberly Kate Ferlic, Granger, IN (US); Richard Anthony de los Santos, Goshen, IN (US); Krissie Marie Littman, Goshen, IN (US)

( * ) Notice: Subject to any disclaimer, the term of this patent is extended or adjusted under 35 U.S.C. 154(b) by 178 days.

(21) Appl. No.: 15/626,752

(22) Filed: Jun. 19, 2017

(65) Prior Publication Data

US 2018/0360149 A1 Dec. 20, 2018

(51) Int. Cl.

| | |
|---|---|
| ***D05B 97/04*** | (2006.01) |
| ***A41H 43/00*** | (2006.01) |
| ***D06H 1/00*** | (2006.01) |
| ***D06H 7/00*** | (2006.01) |
| ***A41H 3/00*** | (2006.01) |
| ***A41H 31/00*** | (2006.01) |

(52) U.S. Cl.

CPC ..... *A41H 43/00* (2013.01); *A41H 3/00* (2013.01); *A41H 31/00* (2013.01); *D05B 97/04* (2013.01); *D06H 1/00* (2013.01); *D06H 7/00* (2013.01)

(58) Field of Classification Search

CPC ..... D05B 97/00; D05B 97/04; D05B 97/12; A41H 43/00; A41H 43/005; A41H 43/02; A41H 43/04; A41H 3/00; A41H 3/04; A41H 3/06; A41H 3/08; A41H 31/00; D06H 1/00; D06H 1/006; D06H 7/00; D06H 7/005; D06H 7/04; D06H 7/02; D06H 7/10; D06H 7/14

See application file for complete search history.

(56) References Cited

U.S. PATENT DOCUMENTS

| | | | | | |
|---|---|---|---|---|---|
| 2,100,104 | A | * | 11/1937 | Johnson | B68G 7/00 112/2.1 |
| 3,143,741 | A | * | 8/1964 | Tyroler | A41D 1/06 2/227 |
| 3,609,766 | A | * | 10/1971 | Olive | A41H 3/04 2/74 |
| 3,675,604 | A | * | 7/1972 | Frost | A41H 42/00 112/130 |
| 3,694,818 | A | * | 10/1972 | Nielson | A41H 31/00 112/475.09 |
| 5,535,451 | A | | 7/1996 | Tassone et al. | |
| 6,543,062 | B1 | | 4/2003 | Amsel et al. | |

(Continued)

*Primary Examiner* — Danny Worrell

(74) *Attorney, Agent, or Firm* — Dunlap Bennett & Ludwig PLLC

(57) ABSTRACT

A method of altering clothing for a more aesthetic fit comprises the application of the Z-plasty surgical technique to clothing. The fabric is marked at the desired point of realignment with a "Z" pattern. The fabric is then cut along the marked "Z" creating two opposing triangular flaps. The flaps are pulled into their new position, with the angles from the center leg of the "Z" rotating to meet the angles of the upper and lower legs of the "Z." The flaps are then stitched into place in the new position, completing the alteration and resulting in a more pleasing fit.

7 Claims, 4 Drawing Sheets

(56) References Cited

U.S. PATENT DOCUMENTS

| | | | | |
|---|---|---|---|---|
| 7,958,569 | B2 * | 6/2011 | Razzaghi | A41D 13/0002 2/62 |
| 8,839,463 | B2 * | 9/2014 | Fier | A41D 1/06 2/227 |
| 8,869,313 | B2 * | 10/2014 | Maramotti | A41D 1/06 2/247 |
| 2011/0214216 | A1 | 9/2011 | Zarabi | |

* cited by examiner

FABRIC REALIGNMENT USING THE Z-PLASTY TECHNIQUE

BACKGROUND OF THE INVENTION

This invention relates to sewing methods for clothing, and more particularly, to using a Z-plasty technique in sewing to obtain a better fit of clothing.

Individuals prefer clothing with a better fit, but struggle to find properly fitted clothing. Often, more aesthetically fitting shirts, pants, or dresses are desired, but cannot be found. Also, certain areas of the body require a differently altered fit from the rest of the garment. Current articles of clothing production methods impair proper aesthetics and/or fit.

There exists a need for a technique of fabric alteration, which improves the fit and aesthetics of an article of clothing.

SUMMARY

In one aspect of the present invention, a method of altering an article of clothing made from a sheet of material includes the steps of marking a desired point of realignment on the material with a Z shaped incision line and cutting along the Z-shaped incision line to form a Z-shaped cut fabric. The Z-shaped cut fabric includes an upper leg and a lower leg, wherein the upper and lower leg are horizontal and parallel to one another, a diagonal center leg connecting the upper and lower leg at their opposing endpoints, a first flap formed by a first vertex between the upper leg and center leg, and a second flap formed by a second vertex between the lower leg and the center leg, the first vertex and second vertex forming equivalent angles. The first flap and the second flap are repositioned such that the first flap falls below the second flap, and the second flap falls above the first flap. The material is attached along the incision lines with the first flap and the second in their rotated positions to form an altered article of clothing.

In one aspect of the invention, the upper leg falls below the lower leg after the first and second flap have been rotated. In another aspect of the invention, the upper leg and lower leg form a new diagonal center line of the Z-shaped cut fabric.

In one embodiment, the material is attached along the incision lines by stitching. In another embodiment, the upper leg, the lower leg and the center leg are of equal lengths.

In one embodiment, the first and second flaps are rotated by the angles equivalent to angles formed by the vertex of the first flap and the vertex of the second flap.

These and other features, aspects and advantages of the present invention will become better understood with reference to the following drawings, description and claims.

DETAILED DESCRIPTION OF THE INVENTION

A description of preferred embodiments of the invention follows. Individuals desire better and more aesthetic fitting clothing. Currently, Z-plasty is used as a plastic surgery technique to improve the functional and cosmetic appearance of scars. It can elongate a contracted scar or rotate the scar tension line. The middle line of the Z-shaped incision (the central element) is made along the line of greatest tension or contraction, and triangular flaps are raised on opposite sides of the two ends and then transposed. The length and angle of each flap are usually the same to avoid mismatched flaps that may be difficult to close.

Figure 1:
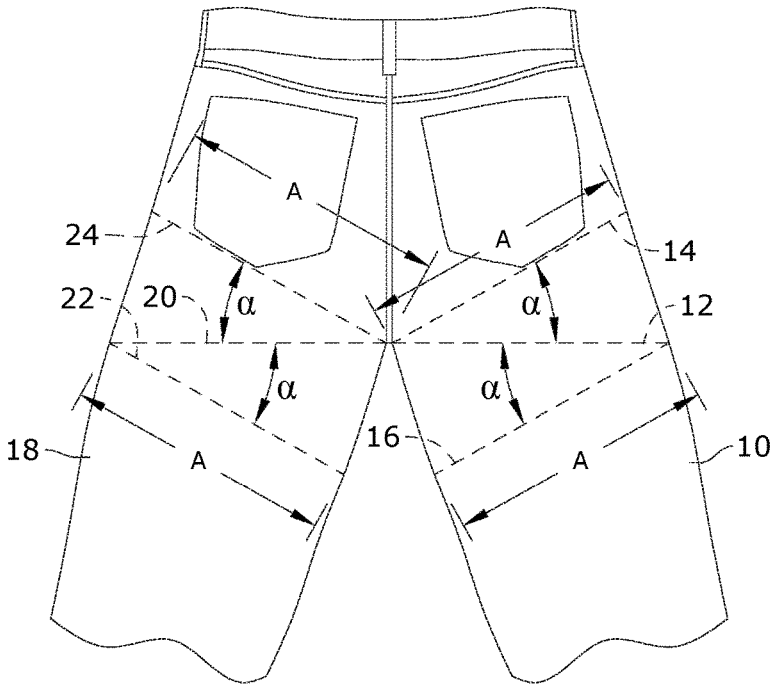
FIG. 1 shows a schematic view of an exemplary application of alteration shown with incisions marked for cutting.

Though the Z-plasty technique has been applied in surgery, the current invention applies the Z-plasty method as a fabric realignment or alteration method to achieve a more aesthetic fit of clothing. One embodiment of the realignment technique is shown in FIG. 1. A backside of a pair of pants is shown with a first pant leg 10 and a second pant leg 18. A first incision line 12 is made on leg 10. A first upper incision line 14 is made and a first lower incision line 16 is made. Length A shows that the incisions lines are all equivalent length. Angle $\alpha$ shows the equivalent angles between the incisions. As can be seen, the shape of the incision lines 12, 14, and 16 form a Z, similar to the Z-plasty technique.

Similarly, pant leg 18 has a second center incision line 20 and a second upper incision line 24. It further includes a second lower incision line 22.

Figure 2:
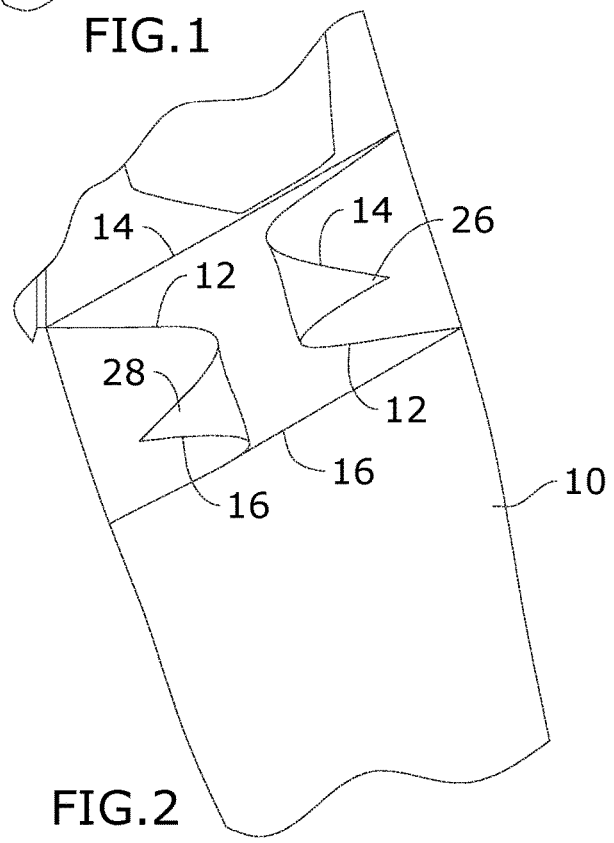
FIG. 2 shows a schematic of one embodiment of a method of alteration, shown with incisions made and flaps pulled up.

In one embodiment, cuts are made along the incision lines. The cut fabric of pant leg 10 is shown in FIG. 2. Cutting along the incision lines produces a first flap 26 and a second flap 28. Flaps 26 and 28 are of equivalent size with identical angles $\alpha$.

Figure 3:
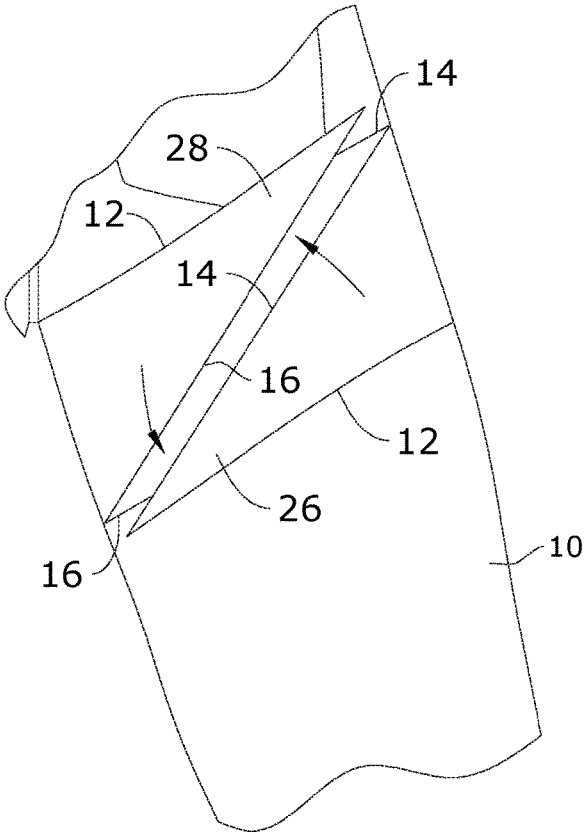
FIG. 3 shows a schematic view of an embodiment of the invention, illustrating the moving of flaps into a new position.
Figure 4:
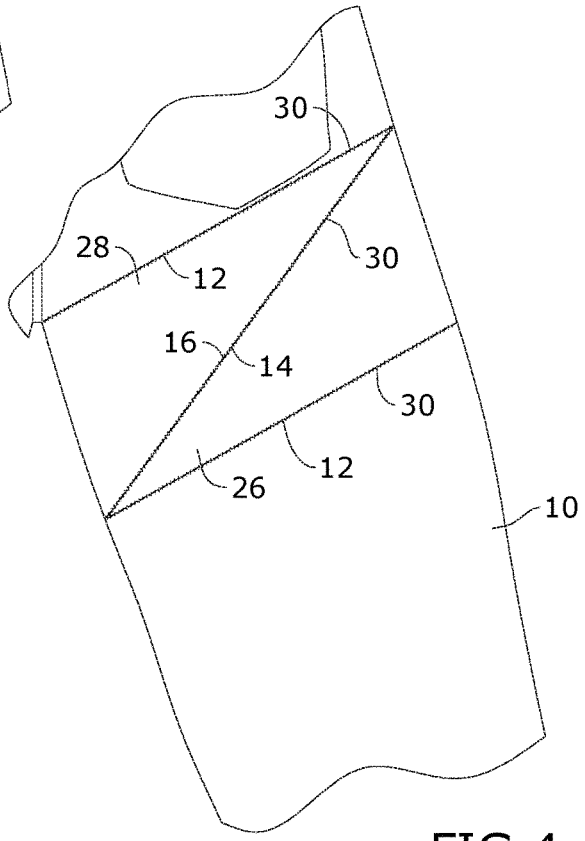
FIG. 4 shows a schematic view of an embodiment of the invention, with flaps stitched in place.

FIG. 3 shows one embodiment of moving of flaps 26 and 28 to create a new seam. Flap 26 is rotated downward and flap 28 is rotated upward. Incision line 16 now falls above incision line 16 and flap 26 now falls below flap 28. Once flaps 26 and 28 are in their new positions, seams 30 are sewn along incision lines 14, 16, and 12 to hold the fabric realignment in place as shown in FIG. 4.

Advantageously, rearranging the fabric and seaming using the Z-plasty technique creates a more aesthetic and comfortable fit in clothing. The modification of pants in the buttock region by application of this alteration method results in a more contoured and aesthetic fit of each buttock.

Figure 5:
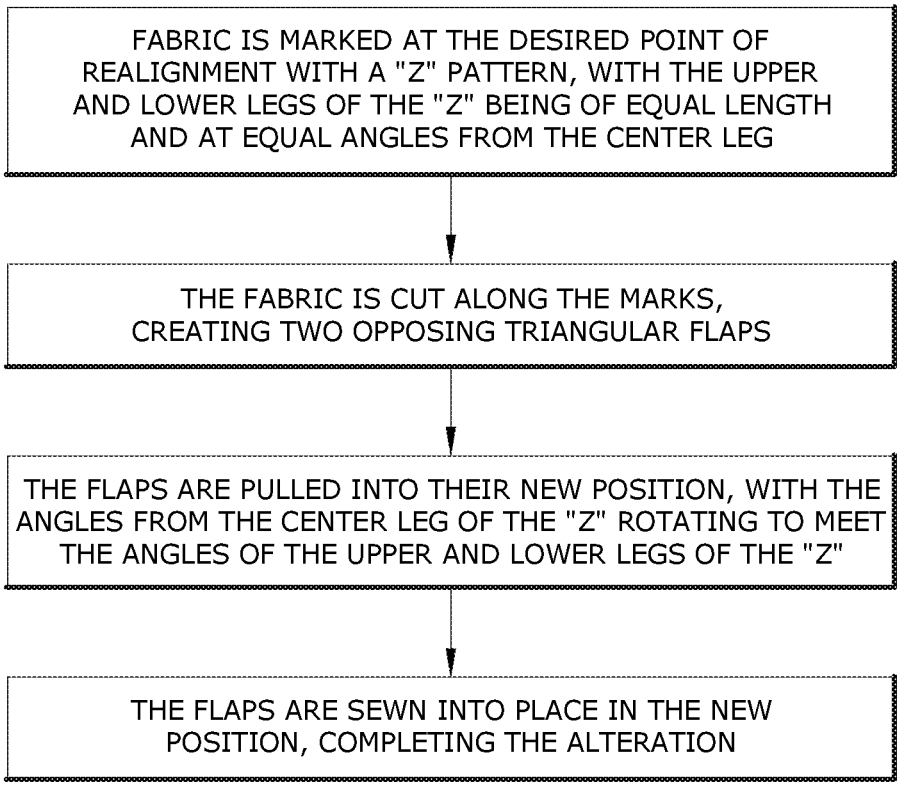
FIG. 5 shows a flow chart of the invention.

A flow chart of the method of fabric realignment with Z-plasty is shown in the embodiment of FIG. 5. The fabric is first marked at the desired point of realignment with a "Z" pattern. The upper and lower legs of the Z are of equal length. The angles between the upper leg and the center leg and the lower leg and the center leg are equivalent.

The fabric is then cut along the marked "Z" creating two opposing triangular flaps. The flaps are pulled into their new position, with the angles from the center leg of the "Z" rotating to meet the angles of the upper and lower legs of the "Z." The flaps are then stitched into place in the new position, completing the alteration.

Figure 6:
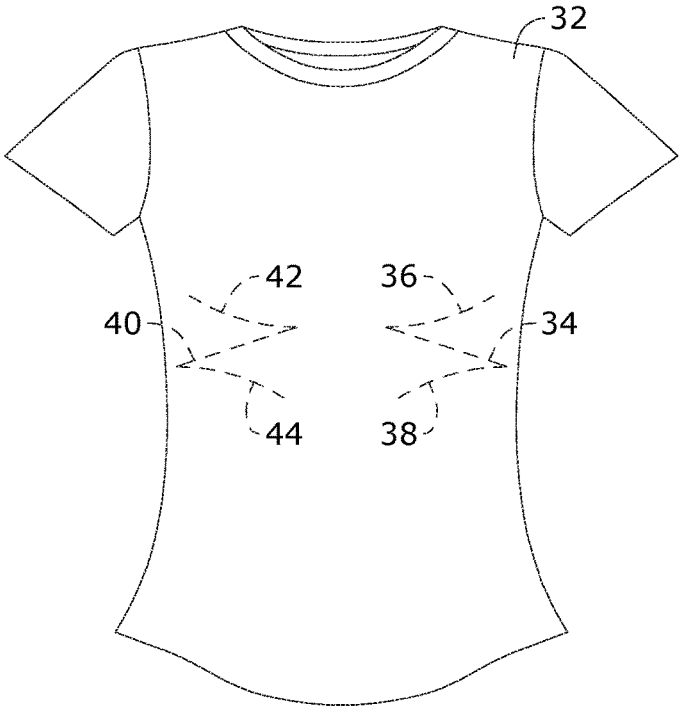
FIG. 6 shows a schematic view of alternative embodiment of a method of alteration shown with incisions marked for cutting.

One embodiment of using the fabric realignment technique to alter a shirt is shown in FIG. 6. A first center incision center incision line 34, a first upper incision line 36, and a first lower incision line 38, are made to create the Z-shape. Similarly, on the other side of the shirt 32, a second center incision line 40, a second lower incision line 44, and a second upper incision line 42 are made. All incision lines on both sides of the shirt are of equivalent length with equivalent angles between each upper incision line and the center incision line as well as each lower incision line and the center incision line. The method of cutting, rotating the flaps, and stitching as previously described is applied to create a more pleasing fit. The modification of the shirt 32 by application of the realignment technique results in a more contoured and aesthetic fit in the chest region.

Figure 7:
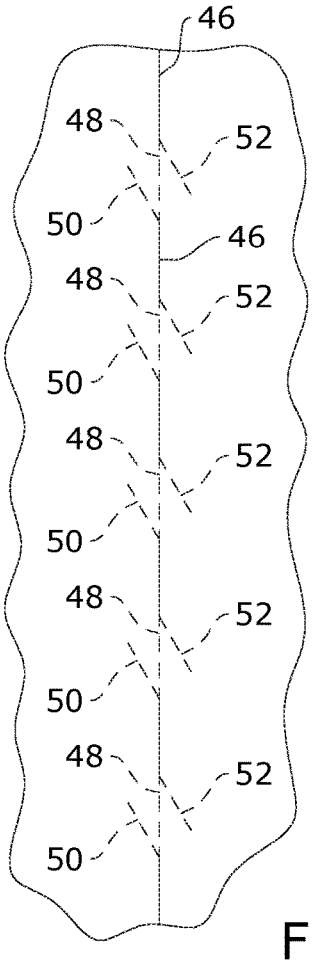
FIG. 7 shows a schematic view of an alternate exemplary application of a method of alteration, shown with incisions marked for cutting.

An alternative embodiment of lengthening an inseam is shown in FIG. 7. A center line of the seam is used as the center incision lines 48. First leg incision lines 50 are made all the way down the inseam. Second leg incision lines 52 are made down the opposite sides of the inseam. The first incision lines 48 and second incision lines 52 are of the same length and of equivalent angle with respect to center incision lines 48. By applying the previously described Z-plasty method to the incisions, the inseam is lengthened for improved comfort.

The Z-plasty technique is already widely applied in the field of medicine. The Z-plasty technique for clothing application can be performed by humans, machines, or augmented by computers. Alternatively, the incisions need not be stitched by sewing, but can alternatively be attached by any suitable method (such as Velcro, snaps, buttons, pins, or other mechanisms).

It should be understood, of course, that the foregoing relates to exemplary embodiments of the invention and that modifications may be made without departing from the spirit and scope of the invention as set forth in the following claims.

What is claimed is:

1. A method of altering an article of clothing made from a sheet of material comprising the steps of:

marking a desired point of realignment on the material with a Z shaped incision line;

cutting along the Z-shaped incision line to form a Z-shaped cut fabric, the Z-shaped cut fabric comprising:

an upper leg and a lower leg, wherein the upper and lower leg are substantially horizontal and parallel to one another, and a diagonal center leg connecting the upper and lower leg at their opposing endpoints;

a first flap formed by a first vertex between the upper leg and center leg; and a second flap formed by a second vertex between the lower leg and the center leg, the first vertex and second vertex forming equivalent angles;

repositioning the first flap and the second flap such that the first flap falls below the second flap, and the second flap falls above the first flap; and reattaching the material along the incision lines with the first flap and the second in their rotated positions to form an altered article of clothing.

2. The method of claim 1, wherein the upper leg falls below the lower leg after the first and second flap have been rotated.

3. The method of claim 1, wherein the upper leg and lower leg form a new diagonal center line of the Z-shaped cut fabric.

4. The method of claim 1, wherein the fabric is reattached by stitching.

5. The method of claim 1, wherein the upper leg, lower leg and center leg are of equal lengths.

6. The method of claim 1, wherein the first and second flaps are rotated by the angles equivalent to angles formed by the vertex of the first flap and the vertex of the second flap.

7. The method of claim 1, wherein multiple Z-shaped cuts are made in a garment to alter the garment in multiple places.

* * * * *